US006687473B2

(12) United States Patent
Wang et al.

(10) Patent No.: US 6,687,473 B2
(45) Date of Patent: Feb. 3, 2004

(54) METHOD AND APPARATUS FOR A NON-CONTACT DIRECT TRANSFER IMAGING SYSTEM

(75) Inventors: Bobo Wang, Palos Verdes Esates, CA (US); Taomo Mu, Shindian (TW); Jon-Shin Hu, Palos Verdes Estates, CA (US); Tan-Feng Tsai, Taichung (TW); Chou-Jiung Lin, Hsinchu (TW); Vincent Lee, Hsinchu (TW)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 10/017,434

(22) Filed: Dec. 14, 2001

(65) Prior Publication Data

US 2003/0113136 A1 Jun. 19, 2003

(51) Int. Cl.[7] ..... G03G 21/00; G03G 15/00

(52) U.S. Cl. ..... 399/99; 399/71

(58) Field of Search ..... 399/71, 99, 53, 399/223, 228, 231, 234, 235, 253, 270, 343, 344

(56) References Cited

U.S. PATENT DOCUMENTS

| | | | | |
|---|---|---|---|---|
| 5,241,357 A | * | 8/1993 | Iwata | 399/231 |
| 5,303,009 A | * | 4/1994 | Nishizawa | 399/71 |
| 5,713,064 A | * | 1/1998 | Kasiske et al. | 399/99 |
| 5,903,797 A | * | 5/1999 | Daniels et al. | 399/71 X |

* cited by examiner

*Primary Examiner*—Sandra L Brase
(74) *Attorney, Agent, or Firm*—Sonnenschein Nath & Rosenthal

(57) ABSTRACT

An imaging system that includes a photoreceptor belt capable of having an electrostatic latent image recorded thereon, a group of developing stations capable of developing a color image on the photoreceptor, and at least one charging means and at least one exposing means to prepare the photoreceptor for desired conditions, such as creating a cleaning patch to remove toner from a toner support member associated with one of the plurality of developing stations.

13 Claims, 6 Drawing Sheets

(time = t1)

(time = t2)

(time = t3)

(time = t4)

(time = t5)

METHOD AND APPARATUS FOR A NON-CONTACT DIRECT TRANSFER IMAGING SYSTEM

FIELD OF THE INVENTION

The present invention relates generally to electrophotography, more particularly, to a non-contact developing system that utilizes only one image-receiving member that transfers images directly to media.

BACKGROUND OF THE INVENTION

Electrophotographic imaging process (or xerography) is a well-known method of copying or otherwise printing documents. In general, electrophotographic imaging uses a charge-retentive, photosensitive surface (known as a photoreceptor) that is initially charged uniformly. The photoreceptor is then exposed to a light image representation of a desired image that discharges specific areas of the photoreceptor surface creating an electrostatic latent image. Toner powder is applied by using a developing system, which carries the toner from a toner container to the latent image, forming a developed image. This developed image is then transferred from the photoreceptor to a substrate (e.g. paper, transparency, and the like).

A color electrophotographic imaging process is typically achieved by repeating the same process described above for each color of toner used and storing each developed color toner image to an accumulator until all desired colors are achieved and than transferred to a substrate (e.g. paper, transparency, and the like).

Previous attempts of producing an imaging system without the use of an accumulator have used redundant charging and exposing systems to prepare the developed toner for passing through each developing station (e.g., Yellow, Magenta, Cyan and Black) without being disturbed by the subsequent developing process. More specifically, each developing station requires an exposing and a charging means to enable the developing process to occur before entering the next developing station. Although adequate imaging can be achieved by using this process, the cost and complexity of the machine is significantly increased due to the need of additional exposing and charging means.

SUMMARY OF THE INVENTION

The present invention is directed to a non-contact developing system for electrophotographic machines that effectively reduces the cost and complexity of typical color electrophotographic imaging systems at the same time enabling the ability to directly transfer a developed image to a substrate (e.g. paper, transparency, and the like) without the use of an accumulator.

In a particularly innovative aspect, the developing system of the present invention reduces the need for redundant charging and exposing means by preparing the subsequent developing station for a desired condition or response before the first developed toner carried by the photoreceptor passes. More particularly, when subsequent developing is not required the subsequent developing station is prepared for a desired condition by cleaning a toner support member of the developing station of any toner before the first developed toner or latent image passes to ensure contamination of colors or partial development does not occur. The method of preparing the subsequent developing stations for a desired condition enables the first developed image to pass through the subsequent developing station and be carried by the photoreceptor to the next available charging and exposing means. Once the first developed toner and the photoreceptor is prepared for an additional developed toner by the next available charging and exposing means it is returned to a desired developing station where an additional color is developed. This process is repeated until the desired colors are achieved and then transferred to a substrate (e.g. paper, transparency, and the like).

BRIEF DESCRIPTION OF THE DRAWINGS

In the figures, like reference numerals designate corresponding parts throughout the different views. The invention may take physical form in certain parts of which will be described in detail in this specification and illustrated in the accompanying drawings, which form a part hereof, wherein.

DETAILED DESCRIPTION OF PREFERRED EMBODIMENTS

Figure 1:
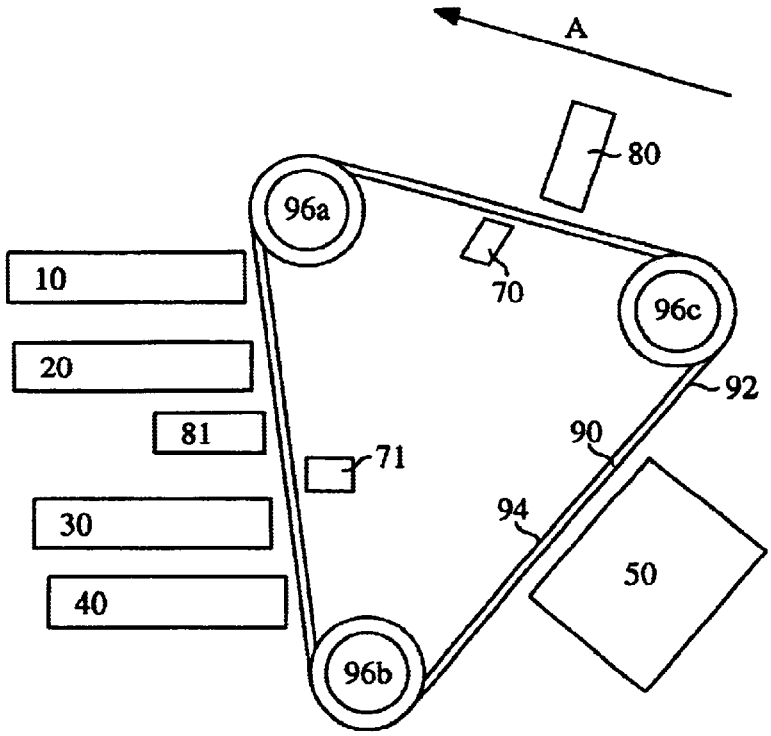
FIG. 1 is a schematic illustrating an imaging system, which employs the present invention.

In the representative embodiment of the invention shown in FIG. 1, an electrophotographic imaging system 100 includes four developing units 10, 20, 30, 40, two charging units 80, 81 and two exposure elements 70, 71. A cleaning station 50 is also utilized in the system. The electrophotographic imaging system 100 also includes a flexible, transparent photoreceptor belt 90 with an outer surface 92 and an inner surface 94. The photoreceptor belt 90 is driven in a continuous path in a direction indicated by arrow A at a velocity v by a plurality of rollers 96*a*, 96*b* and 96*c*.

Each of the developing units 10, 20, 30, 40 contain a different colored developer, for example Y, M, C and K, and are disposed in opposing relationship with the photoreceptor 90 with a gap therebetween defining a developing region. Each of the developing units 10, 20, 30, 40 has a respective toner support member, such as a developing roller 12, 22, 32, 42 shown in FIG. 2A. Each toner support member is adapted to carry a toner thereon to the developing region, thus producing a differently colored image, in superimposed relation, without mechanical devices applying the developer because such contact would disturb previously produced differently colored image.

Since the electrophotographic imaging system of the present invention is a multicolor, multipass imaging system, not all of the four developing stations 10, 20, 30, 40 have their development function turned "on" and operating during any one of the required number of passes, for a particular differently colored image. The remaining developing stations are cleaned and therefore have their development functions turned "off."

Figure 2A:
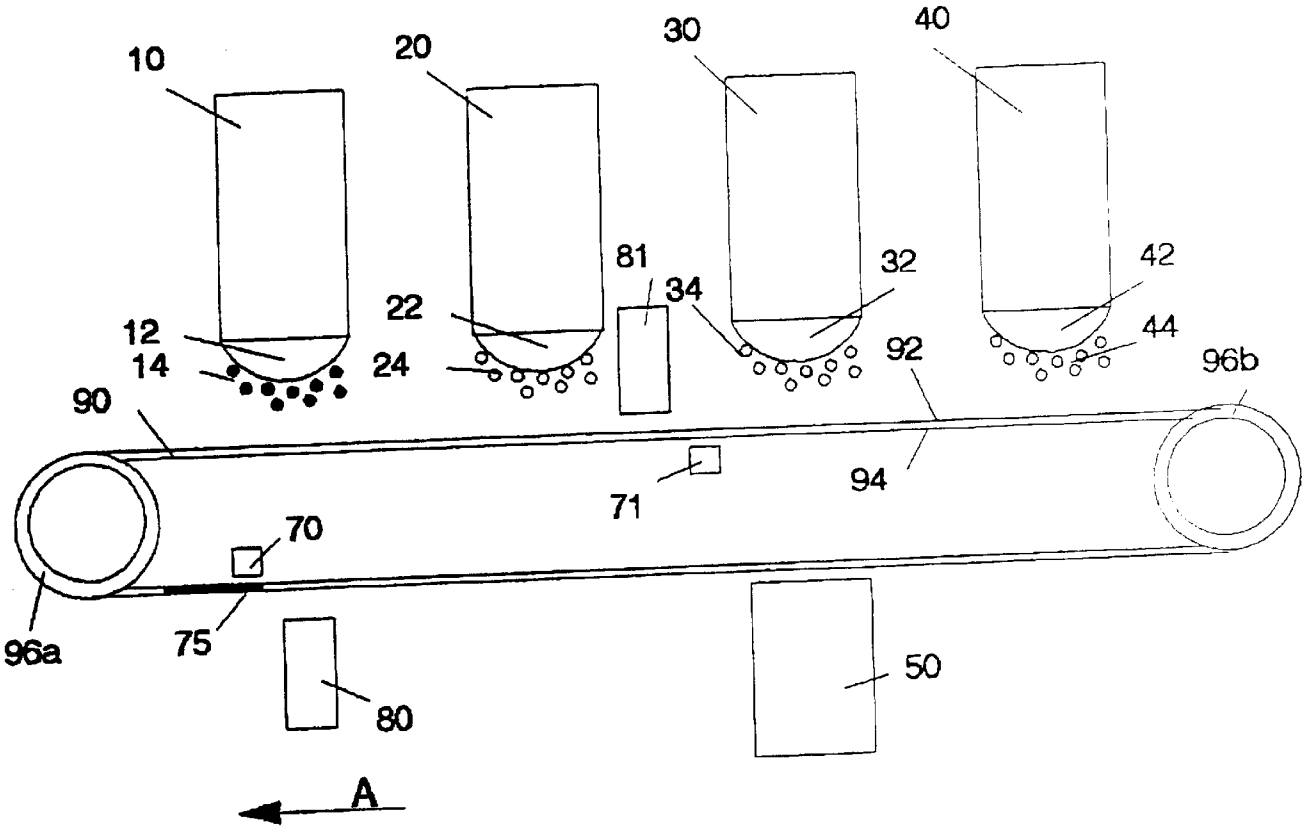
FIGS. 2A–2E are schematics illustrating an exemplary operation of the imaging system in FIG. 1 in accordance with the present invention.

As shown in FIG. 2A, each developing station 10, 20, 30, 40 has a respective developing roller 12, 22 32, 42. Developing rollers 12, 22, 32, 42 are kept in a non-contact state against the photoreceptor belt 90 with a predetermined spacing. At the time of the developing process by the developing belt 90 with a predetermined spacing. At the time of the developing process by the developing station 10, 20, 30, 40 for each color, a developing bias voltage composed of a direct current voltage or an alternate current voltage of a magnitude ranging from −700 volts to −900 volts is applied to the respective developing roller 12, 22, 32, 42 so that non-contact development process can be achieved. When turned "off," the developing roller is not rotated. Accordingly, a finite and limited amount of toner 14, 24, 34, 44 is available for transfer to the photoreceptor belt 90. As discussed below, toner from the "off" developing station can be removed using a "cleaning patch" 75 which is created by charging the photoreceptor belt 90 to an appropriate level and time to attract toner from the developing station. That is, the developing station is "cleaned" by passing the cleaning patch 75 across the path of the developing station that requires cleaning thus causes the toner from the developing station to attract and develop to the cleaning patch 75 on the photoreceptor belt 90. The cleaning station 50 then cleans the cleaning patch 75 at the end of the pass.

In this embodiment, the two charging units 80, 81 are also disposed on the outer surface of the photoreceptor belt 90. The charging units 80, 81 can be an AC or DC corotron, scorotron, dicorotron, a discorotron, a pin scorotron or any other device capable of setting up a uniform electric field on the order of −700 volts magnitude on the photoreceptor belt 90. It should be understood that the actual charge placed on the photoreceptor belt 90 for the first toner (and the other toner layers that are subsequently described) will depend upon many variables, such as toner mass and the settings of a subsequent development station (see below). Charging unit 80 is located upstream from developing stations 10 and 20, while charging unit 81 is located upstream from developing stations 30 and 40.

Figure 2B:
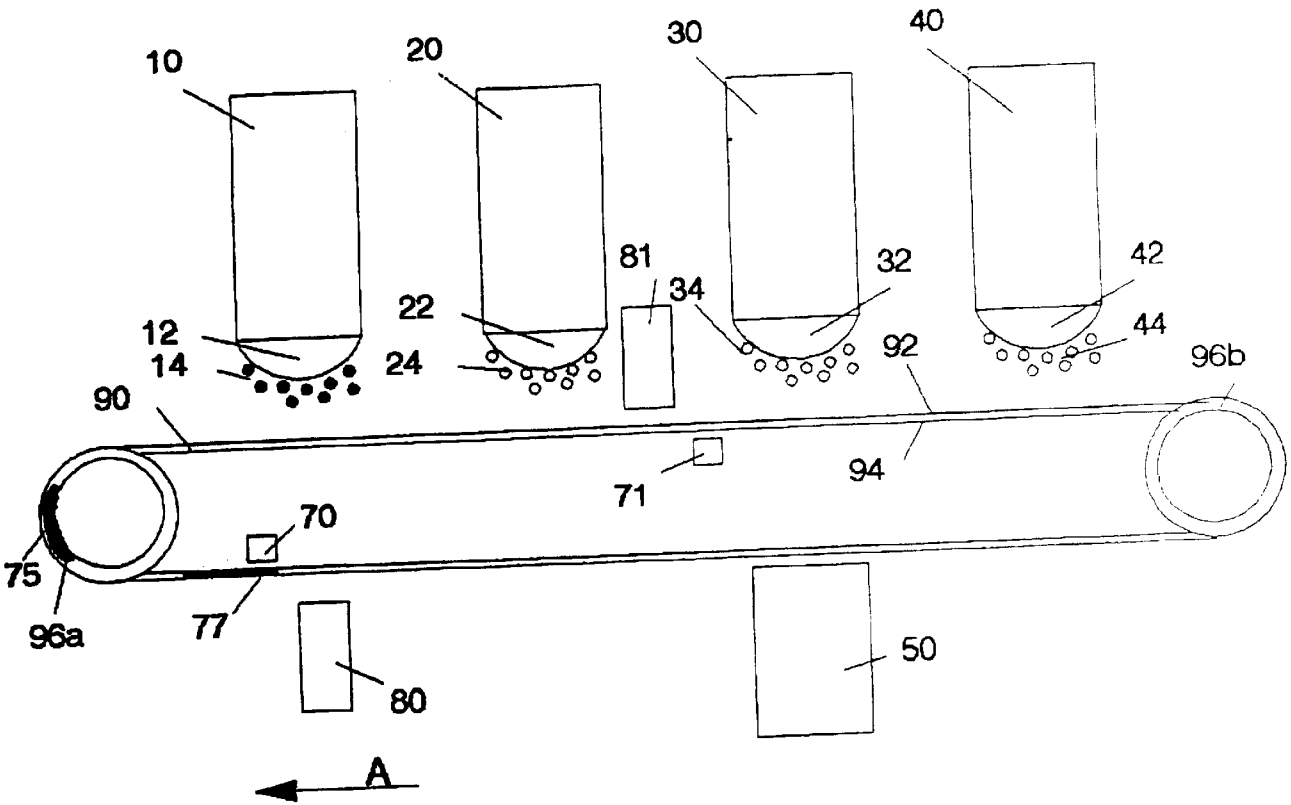
Figure 2C:
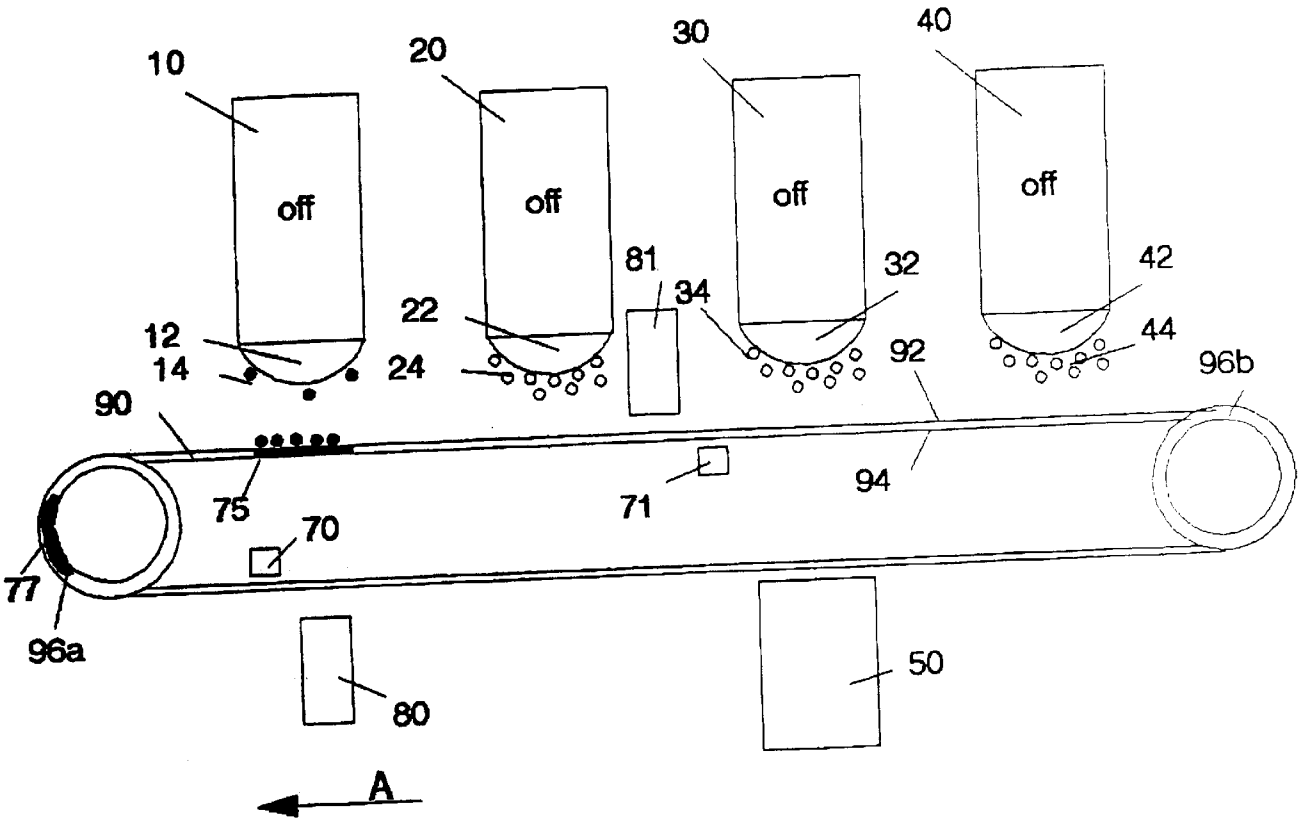
Figure 2D:
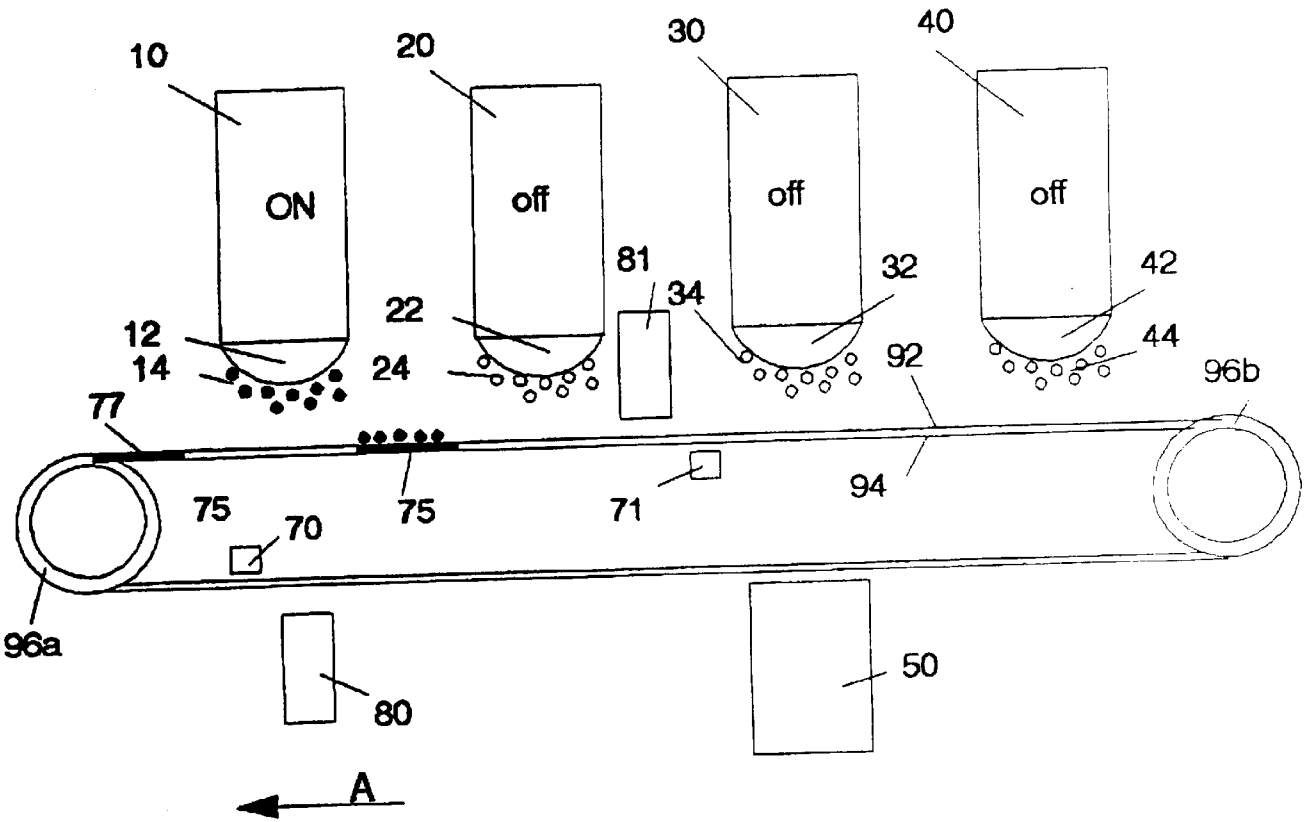

Located downstream from each charging unit 80, 81 is a light source 70, 71, for example a laser or a light-emitting diode ("LED") printer head ("LPH"). The light sources are disposed at or near the inner surface 94 of the photoreceptor belt 90. The light sources 70, 71 include exposure units such as LEDs that are selectively actuated to project light corresponding to a single-color image on the photoreceptor belt 90, thereby discharging, at appropriate locations on the outer surface 92, the uniform electrostatic charge provided by the charging units 80, 81 to produce an electrostatic charge latent image 77 as shown in FIG. 2B. For example, illuminated sections of the latent image area might be discharged by the light beam to about −50 volts in magnatude.

The light sources 70 and 71 are independently capable of discharging the photoreceptor belt at appropriate locations, levels and times to create "cleaning patch" 75 on the belt 90. As with the latent imaging area, cleaning patch 75 has been created by uniformly charging the photoreceptor by means of the charging units 80 and 81 and then discharging the photoreceptor by means of the light sources 70 and 71.

During operation and movement of the cleaning patch 75 and the latent image 77, two relative directions are defined: upstream and downstream. For example, a given developing station is upstream of another developing station if, in a given pass, the imaging area passes the given developing station before it passes the second developing station. Conversely, a given developing station is downstream of a second, if in a given pass, the imaging area passes the given developing station after it passes the second developing station.

Operation of exemplary imaging system of the present invention will now be described in reference to FIGS. 2A–2E. In general, because the present invention employs two photoreceptor charging units 80, 81 and two exposure elements 70, 71 (rather than four), a four-toner subtractive color image requires only two passes of the photoreceptor. During the first pass, the photoreceptor (i.e., a portion of photoreceptor belt 90) is exposed with the pattern for two colors, which are developed. During the second pass, the two exposure elements 70, 71 the photoreceptor with the pattern for the last two colors. Then, the substrate (e.g., paper) is brought into operable relation to the photoreceptor and the four-color image is transferred and later fused.

Rather than ground the developing stations 10, 20, 30, 40 not used in each pass, the present invention cleans those developing stations not being used in each pass using a cleaning patch. Toner accumulated on the cleaning patch is removed as the patch passes cleaning station 50. The cleaning station 50 can be any conventional system known to those skilled in the art. The cleaning station may include a rotatably mounted fibrous brush in contact with photoconductive belt 90 to disturb and remove paper fibers and a cleaning blade to remove the nontransferred toner particles. The blade may be configured in either a wiper or doctor position depending on the application.

During the first pass in one implementation, developing stations 20 and 40 remain "off" while developing stations 10 and 30 are turned "on" at specified times. These times may be determined by an appropriate algorithm and controlled by a microprocessor (not shown). Specifically, during the first pass, at time to, charging unit 80 charges the photoreceptor belt 90 to a uniform charge between −700 volts to −900 volts. As shown in FIG. 2A, at time $t_1$, the light source 70 imposes a cleaning patch 75 on the photoreceptor belt 90 by discharging the belt 90 to about −50 volts. As the photoreceptor belt 90 moves, at time $t_2$, the light source 70 then imposes a latent image 77 (shown in FIG. 2B) on the photoreceptor belt 90 by discharging the belt. The latent image 77 is preferably formed a distance L from the cleaning patch 75 such that the distance L is equal to the distance between the developing station 10 and the developing station 20.

As the photoreceptor belt 90 moves, at time $t_3$ (shown in FIG. 2C) the cleaning patch 75 approaches developing station 10 which is "off" (i.e., not rotating). The cleaning patch therefore incidentally removes some toner 14 from the developing station 10. Once the cleaning patch 75 passes developing station 10 at time $t_4$ (shown in FIG. 2D), developing station 10 is turned "on." Then, at time $t_5$ (shown in FIG. 2E), the latent image 77 approaches developing station 10, while the cleaning patch approaches developing station 20 which is "off" (not rotating).

Figure 2E:
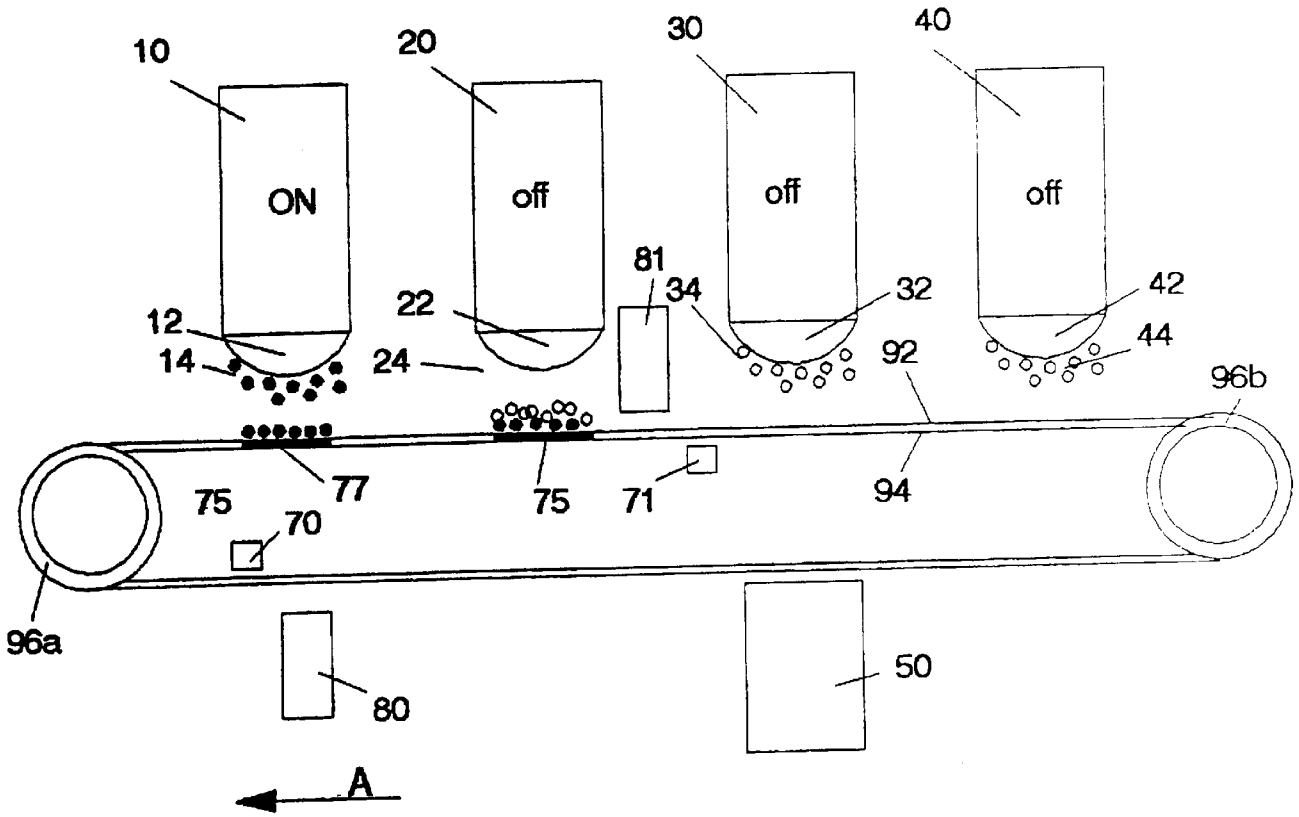

FIG. 2E shows that as the latent image area 77 passes a developing station 10, charged toner particles 14 are deposited onto the image area. The charged toner particles 14 adhere to the illuminated areas of the image area thereby causing the voltage of the illuminated parts of the image area to be about −250 volts. The non-illuminated parts of the image area remain at a voltage of −700. As the cleaning patch 75 passes developing station 20, toner 24 having a voltage of about −200 volts is attracted to the cleaning patch, thereby cleaning the developing station 20 of toner 24.

FIG. 2E further shows that as the latent image 77 approaches the developing station 20, little or no toner 24 remains on the developing station 20 to contaminate the latent image 77. In addition, because the developing station 20 is not grounded, the toner 14 on the latent image does not contaminate the developing station 20.

A similar process is repeated for developing stations 30 and 40. The second charging unit 81 recharges cleaning patch 75 and the area of latent image 77 to the charge level desired for exposure and development of the next color image. The recharged cleaning patch 75 and image area 77 with its first toner layer then advances to the light source 71.

After passing the exposure station, the now exposed cleaning patch 75 advances past another development station 30, incidentally cleaning it, and approaches developing station 40 (which is "off") to remove the toner from developing station 40. The latent image created by light source 71 attracts toner from developing station 30. Since the image area 77 already has a first toner layer produced at developing station 10, the developing station 30 should use a scavengeless developer. Because developing station 40 has been cleaned by the cleaning patch, there is no contamination as the latent image moves by that developing station. The toner on the cleaning patch 75 is then cleaned by the cleaning station 50.

The second cycle then begins. In this implementation for the second cycle, developing stations 10 and 30 are "off" while developing stations 20 and 40 are turned on at specified times. Again, these times may be determined by an appropriate algorithm and controlled by a microprocessor. Furthermore, the charging units 80 and 81 can be arranged to be independently capable of charging the photoreceptor belt at appropriate locations, levels and times to create a "cleaning patch" on the belt 90. More specifically, the charging units 80 and 81 can vary in voltage levels and times in creating a uniform electric field on the order of −700 volts magnitude on the photoreceptor belt 90 and in creating a uniform electric field on the order of −50 volts magnitude on the photoreceptor belt 90 thus creating a cleaning patch by means of charging the photoreceptor belt 90 with variant voltage magnitudes.

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. An image system comprising:

a photoreceptor capable of having an electrostatic latent image recorded thereon; and a plurality of developing stations capable of developing a color image to the photoreceptor, at least one of the plurality of developing stations having toner and being operably configured to apply a voltage between −700 volts to −900 volts to the toner; and at least one charging means and at least one exposing means to prepare the photoreceptor for a desired condition such that the toner is attracted away from the at least one of the plurality of developing stations, wherein the desired condition corresponds to preparing a portion of the photoreceptor to remove toner from one of the plurality of developing stations to substantially prevent the transfer of the toner from the one developing station to another portion of photoreceptor.

2. A method of preparing an imaging system to produce color images utilizing at least one charging unit, the method of comprising the steps of:

creating a cleaning patch by charging a photoreceptor of the imaging system to a predetermined level; and cleaning a toner support member of the imaging system by developing toner onto the cleaning patch; and removing toner from the cleaning patch to a toner waste station associated with the imaging system.

3. A method of preparing an imaging system to produce color images using at least one charging unit, the method comprising the steps of:

(a) creating a cleaning patch by discharging a portion of a photoreceptor to a predetermined level;

(b) imposing a latent image on the photoreceptor by discharging another portion of the photoreceptor;

(c) cleaning a toner support member of the imaging system by developing toner onto the cleaning patch; and (d) removing toner from the cleaning patch to a toner waste station associated with the imaging system.

4. The method of claim 3, wherein the latent image is formed at a distance equal to the distance between two developing stations.

5. The method of claim 3, wherein the steps (a) through (d) are performed in the order recited in claim 3.

6. A method of preparing an imaging system to produce color images, the imaging system comprising at least two developing stations, the method comprising the steps of:

(a) preparing a first of the at least two developing stations for a desired condition by cleaning a toner support member at the first developing station;

(b) developing toner onto a photoreceptor at a second of the at least two developing stations to create a first developed image;

(c) passing the first developed image adjacent to the first developing station;

(d) passing the first developed image to the next available charging station;

(e) passing the first developed image to the next available exposure station;

(f) passing the first developed image to a desired one of the at least two developing stations;

(g) developing toner onto the photoreceptor at the desired developing station to create a subsequent developed image; and (h) transferring the subsequent developed image to a substrate.

7. The method of claim 6, wherein the first developing station is situated downstream from the second developing station.

8. The method of claim 6, wherein the steps (a) through (g) are repeated until a desired image is developed.

9. The method of claim 8, wherein the toner developed in each step (g) is of the same polarity as any previous or subsequent steps (g).

10. The method of claim 6, wherein the step of preparing the first developing station comprises the step of creating a cleaning patch by discharging a portion of the photoreceptor to a predetermined level.

11. A method of preparing an imaging system to produce color images, the imaging system comprising at least two developing stations, the method comprising the steps of:

(a) developing toner onto a photoreceptor at a first developing station to create a first developed image;

(b) preparing a subsequent developing station located downstream from the first developing station for a desired condition by cleaning toner from a toner support member at the subsequent developing station;

(c) passing the first developed image adjacent to the subsequent developing station;

(d) passing the first developed image to the next available charging station;

(e) passing the first developed image to the next available exposure station;

(f) returning the first developed image to a desired one of the at least two developing stations;

(g) developing toner onto the photoreceptor at the desired developing station to create a subsequent developed image; and (h) transferring the subsequent developed image to a substrate.

12. The method of claim 11, wherein the steps (a) through (g) are performed in the order recited in claim 11.

13. The method of claim 11, wherein the steps (a) through (g) are repeated until a desired image is developed.

* * * * *